United States Patent [19]

Whitmore

[11] 4,291,109

[45] Sep. 22, 1981

[54] ADDITIVE COLOR IMAGING USING A SILVERLESS RECORDING ELEMENT

[75] Inventor: Keith E. Whitmore, Rochester, N.Y.

[73] Assignee: Eastman Kodak Company, Rochester, N.Y.

[21] Appl. No.: 97,254

[22] Filed: Nov. 26, 1979

[51] Int. Cl.[3] ..... G03C 7/04; G03C 5/18; G03C 5/00

[52] U.S. Cl. ..... 430/42; 430/44; 430/126; 430/54; 430/146; 430/148; 430/152; 430/228; 430/333; 430/363; 430/364; 430/367; 430/394

[58] Field of Search ..... 430/126, 44, 42, 152, 430/228, 383, 333, 363, 364, 367, 394, 146, 148, 54

[56] References Cited

U.S. PATENT DOCUMENTS

| | | | |
|---|---|---|---|
| 2,681,857 | 6/1954 | Rogers | 430/7 |
| 3,215,529 | 11/1965 | Lindquist et al. | 430/152 |
| 3,218,163 | 11/1965 | Acton et al. | 430/44 |
| 3,253,913 | 5/1966 | Smith et al. . | |
| 3,410,686 | 11/1968 | Prater | 430/152 |
| 3,510,297 | 5/1970 | Herrick et al. | 430/152 |
| 3,515,549 | 6/1970 | Bixby | 430/152 |
| 3,536,490 | 10/1970 | Hochberg | 430/152 |
| 3,734,737 | 5/1973 | Sharp | 430/7 |
| 3,849,138 | 11/1974 | Wyckoff | 430/142 |
| 3,898,082 | 8/1975 | Giamo . | |

FOREIGN PATENT DOCUMENTS 1161134 1/1964 Fed. Rep. of Germany .

OTHER PUBLICATIONS

Hsu; R., "Research Disclosure", #14219, 2/1976.

Kifamura et al., Chemical Abstracts, #85:102377a, 1976.

Kosar; J., "Light-Sensitive Systems", J. Wiley & Sons, 1965, pp. 196–198.

*Primary Examiner*—Charles L. Bowers, Jr.

*Attorney, Agent, or Firm*—Donald W. Strickland

[57] ABSTRACT

Disclosed herein is a method and apparatus for producing color transparencies on a recording element comprising an additive color filter screen having disposed thereon a coating of a visible light-transmissive, invisible light-sensitive, silverless material, preferably a diazo or vesicular material. The method comprises the steps of imagewise exposing a panchromatic auxiliary layer, e.g. a photoconductive layer, to a multicolored object, such exposure being made through the recording element of the invention. This step acts to produce in the auxiliary layer a monochrome image containing color image information of the multicolored object. Next, the silverless material is exposed to invisible actinic radiation, such exposure being made through the monochrome image formed in or on the panchromatic auxiliary layer. This step serves to transfer the color image information from the auxiliary layer to the silverless layer of the recording element.

5 Claims, 7 Drawing Figures

ADDITIVE COLOR IMAGING USING A SILVERLESS RECORDING ELEMENT

BACKGROUND OF THE INVENTION

1. Field of the Invention

This invention relates to improvements in devices and methods for making and/or replicating color transparencies, such as color slides and cine film. Moreover, it relates to a unique silverless recording element for color imaging.

2. The Prior Art

The use of an additive color filter screen to produce, in cooperating with a pan-sensitive, black-and-white silver halide emulsion, a positive color transparency is well known. According to the once commercial Dufaycolor process, the silver halide emulsion is imagewise exposed through the color screen to produce a black-and-white image containing color information of the subject. The color screen, which may be separable or inseparable from the silver halide layer, typically comprises a mosaic of red, green and blue filter elements which may be random or regular in their arrangement. Upon developing the silver halide layer by the reversal process, illuminating the resulting image with white light and viewing the image through the color screen, the colors of the original subject are seen. The synthesis of the colors of the original subject is obtained by the additive mixture of the light transmitted by the many small red, green and blue filter elements of the screen. The Dufaycolor process is disclosed in U.S. Pat. No. 1,003,720 issued to Dufay, and discussed in Photography—Its Materials and Processes, by Neblette, 6th Edition (1962), pp. 431–435. Reference can also be made to History of Color Photography by Friedman, 1944, Chapters 12–14.

In addition to the above-mentioned Dufaycolor color imaging process, the currently commercial Polavision process represents another example of a process which makes use of the combination of an additive color screen and a silver halide emulsion to produce full color transparencies. This process, which makes use of silver diffusion transfer technology, is disclosed, for example, in U.S. Pat. No. 3,990,895 issued to Land.

In the color imaging processes of Dufay and Land, the developed silver halide emulsion functions merely as a mask to block out, or at least reduce the intensity of, those color components of the illuminating white light source which were either not present or subdued in the original subject. Silver-containing emulsions, of course, tend to be costly in terms of raw materials and manufacturing costs; moreover, most silver emulsions require liquid processing. Thus, it would be desirable to find a silverless substitute.

Two interesting classes of silverless, yet radiation-sensitive, materials which might be considered as substitutes for the silver-containing emulsions mentioned above are the vesicular and diazotype materials. Such materials are relatively inexpensive to make and simple to process; further, these materials can be made virtually transparent to visible radiation. Unfortunately, however, vesicular and diazotype materials have heretofore been disqualified for use in the above process as a result of their insensitivity to visible radiation. Vesicular materials, for example, are primarily sensitive to near ultraviolet radiation, the maximum wavelength of sensitivity being about 3850 Å. Only a few specially sensitized diazotype materials exhibit a maximum wavelength sensitivity of 5000 Å. Hence, neither of these materials is capable of "seeing" subjects of all colors in the visible spectrum (i.e. from 4000 to 6500 Å).

In Research Disclosure No. 14219, February 1976, there is disclosed the concept of using a toner image, formed on a photoconductive layer by the well-known electrographic process, as a mask through which a vesicular layer can be imagewise exposed. The photoconductive and vesicular layers form two layers of multilayer recording elements. In use, the photoconductive layer is imagewise exposed to visible radiation to form a latent electrostatic image. This latent image is then developed with a black pigment (i.e. toner) and the vesicular layer is then flash exposed to ultraviolet radiation through the toner image on the photoconductive layer. Such a laminar construction of the recording element and the two exposure steps enable visible radiation from the original subject to be recorded in the vesicular layer. This process, however, is inherently a monochrome process and offers no capability of recording full color images.

SUMMARY OF THE INVENTION

According to the invention, there is provided a new method and apparatus for producing color transparencies on a recording element comprising an additive color screen having dispersed thereon a coating or layer of a visible light-transmissive, invisible light-sensitive, silverless material. Preferably such a material is either a vesicular or diazotype material. The method of the invention comprises the step of imagewise exposing a panchromatic auxiliary recording element to visible light through the color screen and its silverless coating to produce in the auxiliary element a monochrome image containing color information of the original subject. Next, the silverless layer of the recording element of the invention is flood exposed to invisible actinic radiation (e.g. ultraviolet radiation) through the monochrome image. This second exposure step has the effect of transferring color information from the monochrome image to the image formed in the silverless layer. Finally, the image in the silverless layer is intensified or developed, such as by subjecting such layer to thermal energy or to a suitable vapor. Upon positioning the recording element before a white light source and viewing the image in the silverless layer through the color screen, all of the colors of the original subject can be seen.

In contrast with the prior art recording elements, the silverless recording element of the invention has the potential for substantial cost-savings, in terms of reduced costs of production and raw materials. Further, the recording element of the invention can be dry processed and can be ready for viewing much earlier than prior art color transparencies.

The apparatus of the invention comprises means for imagewise exposing a panchromatic layer through an additive color screen to produce a monochrome image containing color information of the subject being imaged, and means for exposing a layer containing an invisible light-sensitive silverless material to actinic radiation through the monochrome image formed on the panchromatic layer, thereby transferring the color image information in the panchromatic layer to the silverless layer.

The invention and its various advantages will be best understood by those skilled in the art from the ensuing detailed description of preferred embodiments, reference being made to the accompanying drawings.

DETAILED DESCRIPTION OF PREFERRED EMBODIMENTS

Figure 1A:
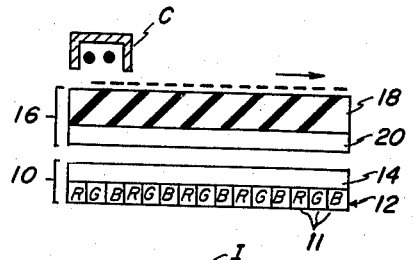
FIGS. 1A–1E depict a sequence of steps of a preferred method of the invention for recording a color image in recording element structure in accordance with the invention.

Referring now to the drawings, there is illustrated in FIG. 1A a recording element 10 structured in accordance with the principles of the present invention. Recording element 10 comprises an additive color filter screen 12 having a silverless imaging layer 14 disposed on its upper surface. The color filter screen may be, for example, of the variety disclosed in my copending U.S. patent application Ser. No. 008,819 filed on Feb. 2, 1979 and entitled "Imaging with Non-Planar Support Elements." Alternatively, screen 12 may be of the type disclosed in the aforementioned patents to Dufay and Land. Typically, the color filter screen comprises a mosaic of tiny (e.g. 10 microns across) color filter elements 11, each being adapted to transmit only one of the three so-called primary colors, i.e. red, green or blue. The smaller the filter elements, of course, the less likely the additive color screen will be resolved in the color image. The arrangement of the different colored filter elements may be regular, as disclosed, for example, in the aforementioned U.S. Pat. No. 3,990,895, or random, as disclosed, for example, in the aforementioned "History of Color Photography" by Friedman. For the sake of illustration, however, the color filter elements of screen 12 are regularly arranged, as shown in the schematic cross-sectional views of all the drawings, and are red, R, green, G, and blue, B, in color.

As regards the silverless imaging layer 14, it is preferably of the well-known vesicular variety, comprising a vesiculating agent dispersed in a substantially "transparent" (i.e. in the sense that it transmits visible radiation) non-permeable binder. The binder can be selected from poly(vinyl chloride), poly(vinylidene chloride), and polystyrene; and copolymers obtained by copolymerizing acrylonitrile with vinyl chloride, styrene, vinylidene chlorofluoride, or 1,1-difluoroethylene; by copolymerizing vinyl chloride with methyl acrylate, acrylic acid, diethyl maleate, or vinyl acetate, or by copolymerizing vinylidene chloride with vinyl chloride, vinyl acetate, vinyl alcohol, ethyl acrylate, or acrylonitrile. Examples of the homo- or co-polymerization of vinylidene chloride are described in U.S. Pat. No. 3,032,414 issued to R. James. Additionally, polysulfonamide binders as described in Research Disclosure, Vol. 131, Publication No. 13107, March 1975, can be used. The vesiculating agent is most commonly a nitrogen-releasing compound, of which diazonium salts are typical. Typical examples of such vesiculating agents are described in the aforesaid Research Disclosure, as are certain prenucleation techniques and the coating techniques for the formation of the vesiculating layer. The vesicular process makes use of the nitrogen released during an exposure of the vesiculating agent (e.g. the diazonium salt) to ultraviolet radiation. On subsequent heating, the nitrogen gas expands to form microscopic vesicules which scatter incident light and thereby constitute the vesicular image. When vesicular prints are used as a transparency, the light scattering elements appear dark against the white light-transmitting background.

As indicated above, vesicular materials are commonly transparent and non-responsive to visible radiation. Hence, visible or "white" light having a wavelength between 4000–6500 Å has no substantial effect on the vesicular layer and passes directly through it. In order to use recording element 10 to record color information, it is necessary to use it in combination with an auxiliary recording element 16 which is panchromatic in sensitivity. Preferably, element 16 comprises a pansensitive photoconductive layer 18 having a conductive backing 20 which is transmissive of both visible radiation and the ultraviolet radiation to which the vesicular layer is sensitive. Photoconductive layer 18 must also be capable of transmitting such ultraviolet radiation. Suitable photoconductive layers are those disclosed in Research Disclosure, Vol. 109, Publication No. 10938, May 1973. A suitable conductive backing is a thin film of tin oxide or nickel.

When the panchromatic element 16 comprises a photoconductive layer, the first step of the process of the invention is to sensitize the photoconductive layer by applying a uniform charge, shown as a negative (−) charge in FIG. 1A. Such a uniform charge can be effected by electrically grounding conductive backing 20 while moving the photoconductive layer relative to a conventional corona discharge device C at a constant rate.

Figure 1B:
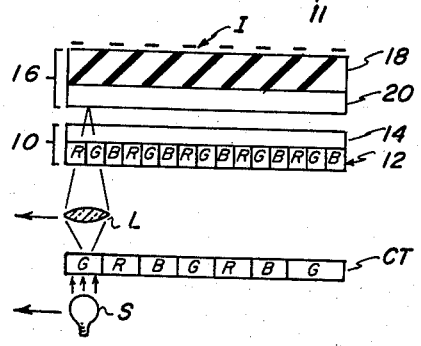
Figure 1C:
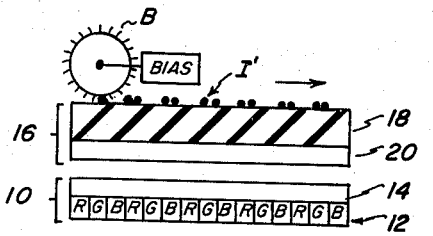

Upon uniformly charging photoconductive layer 18, the next step is to imagewise expose the photoconductor to visible light transmitted or reflected by a multicolored object. This imagewise exposure step is effected through the color screen 12, as shown in FIG. 1B, where a color transparency CT, backlit by a white light source S, serves as the multicolored object. As indicated above, both the vesicular layer 14 and the conductive backing 20 of the auxiliary element transmit visible light and, hence, will not substantially alter the color content of the radiation passing through the color screen and striking the photoconductive layer. This imagewise exposure step can be effected in any one of a variety of ways, such as by scan exposing an original color subject O with a moving lens L and light source S, as shown schematically in FIG. 1B.

The result of imagewise exposing the photoconductive layer 18 through the color screen is to selectively dissipate the uniform charge in the exposed areas, leaving behind a latent charge image I which contains the color information of the original. Each filter element 11, of course, acts to selectively transmit only that light of the multicolored object which is of the same color as the filter element. Thus, green filter elements G transmit only the green color content of the object, etc., all other colors are absorbed.

Development of charge image I can be effected by conventional liquid or dry electrographic development techniques, whereby pigmented electroscopic toner particles are applied to the charge image to produce a visible monochrome image I'. For the sake of illustration, such toner particles are shown as being applied by a conventional magnetic development brush B. If it is desired to ultimately record a positive color image in recording element 10, then it is necessary that the monochrome image I' be a negative image of the multicolored object. Such a negative image can be produced by reversal development techniques, as disclosed in Electrophotography by R. M. Schaffert, Focal Press Limited, 1965. When reverse developed, toner is applied to the uncharged regions of the photoconductive layer.

In forming the monochrome image on the auxiliary element 16, it is preferred that elements 10 and 16 be contiguously arranged. To facilitate developing the monochrome image, the auxiliary element can be physically separated from recording element 10. However, if so separated, elements 10 and 16 must be returned to the same registry (as existed during the aforementioned imagewise exposure step) before continuing the process. If not separated for development of the monochrome image, it is important to maintain registry between elements 10 and 16 throughout the process of the invention. A conventional pin registry technique can be used to produce and maintain the requisite registration.

Figure 1D:
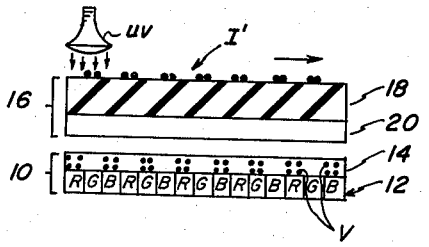
Figure 1E:
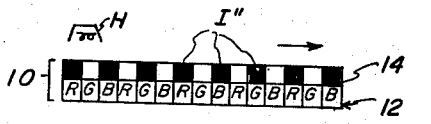

Upon developing the charge image on the photoconductive layer 18 to form a visible monochrome image I', a source 22 of ultraviolet radiation is directed at the auxiliary recording element to effect an imagewise exposure of the vesicular layer 14 through the developed image (see FIG. 1D). The monochrome image, of course, acts as a mask, and the toned portions serve to prevent the ultraviolet radiation incident thereon from exposing the vesicular layer. The ultraviolet exposure of the vesicular layer serves to transfer the color image information contained in the toner image to the vesicular layer. Where exposed to ultraviolet radiation, the vesicular layer forms the aforementioned light-scattering vesicles V. This positive image in the vesicular layer can be intensified (darkened) by heating the vesicular layer with a radiant heater H, as shown in FIG. 1E, to form a developed vesicular image I''.

Figure 2:
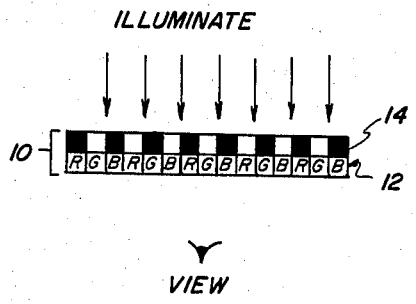
FIG. 2 is a schematic cross-section of the recording element of the invention after it has recorded a color image and is ready for viewing.

Upon carrying the aforedescribed sequence of steps, the color image of the original subject O can be seen in recording element 10 by back illuminating the vesicular layer with white light, and viewing the vesicular image through the color screen. (See FIG. 2).

Figure 3:
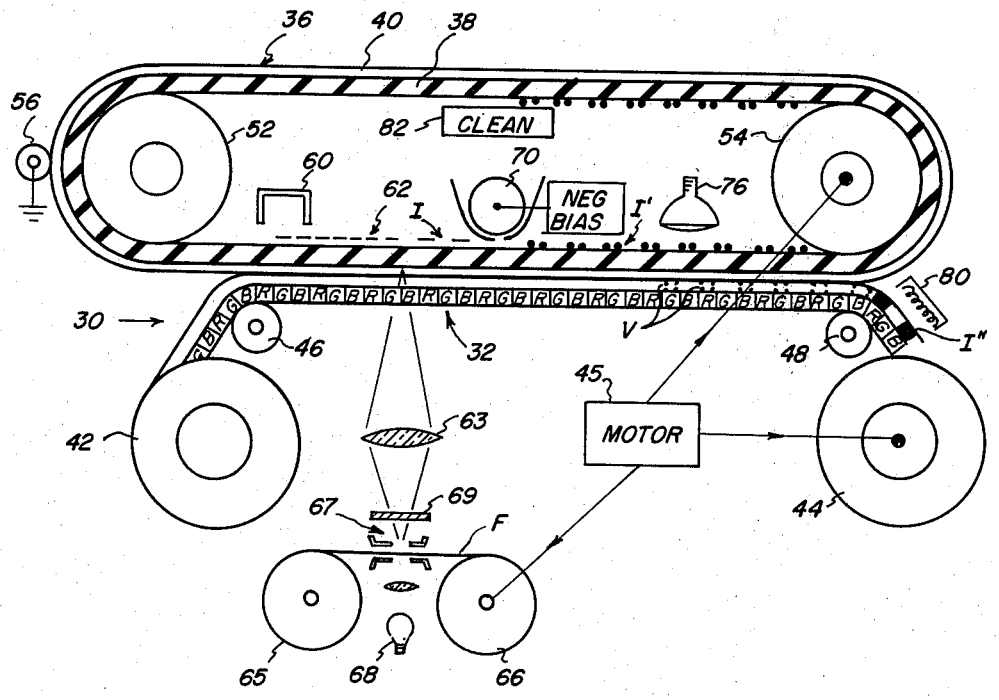
FIG. 3 is a schematic illustration of a preferred apparatus for duplicating a color cine film on a recording element structured in accordance with the principle of the invention.

Referring now to FIG. 3, there is schematically illustrated a preferred embodiment of an apparatus for duplicating color cine film or the like on a silverless recording element 30 of the type described above. Recording element 30 is in the form of a web which stands between a flanged supply reel 42 and a flanged take-up reel 44, the latter being driven in the direction of the arrow by a motor 45. A pair of guide rollers 46 and 48 serve to position the recording element adjacent to an auxiliary recording element 36 which serves the same purpose as auxiliary element 16 described above.

Recording element 30, like recording element 10, comprises a color filter screen 32 having a vesicular layer 34 disposed on the upper surface thereof. Both the vesicular layer and the color screen are the type described in connection with the process depicted in FIGS. 1A–1E.

Auxiliary recording element 36 is in the form of an endless photoconductive web comprising a photoconductive layer 38 having a transparent, electrically conducting backing 40. The endless photoconductive web is supported by a pair of rollers 52 and 54, roller 54 being driven in the direction of the arrow by motor 45 so as to move the photoconductive auxiliary recording element at the same linear speed as that at which recording element 30 is advanced. Here again, a pin registry technique can be used to maintain registration between elements 30 and 36. An electrically grounded roller 56 rotates in frictional engagement with the endless auxiliary recording element, serving to electrically ground the conductive backing 40.

In operation, the photoconductive layer 38 of the auxiliary recording element is uniformly electrostatically charged by a conventional corona discharge device 60. The uniform charge on the photoconductive layer is then selectively discharged at an exposure station 62. At exposure station 62, a color image of an original cine film F is projected by a lens 63 onto the photoconductive layer of the auxiliary recording element. The cine film 64 is advanced between supply and take-up reels 65 and 66, respectively, a span of the film passing through a projection gate 67. The movement of the cine film is synchronized with the movement of recording elements 30 and 40 via motor 45 which drives take-up reel 66. Cine film positioned in projection gate 67 is illuminated by a white light source 68, i.e. a source which emits in the visible region of the electromagnetic spectrum. A filter 69 serves to absorb ultratiolet radiation, thereby preventing any photolysis of the vesiculating agent in layer 34.

Upon forming a latent electrostatic image I on the photoconductive layer of the auxiliary recording element, this image is developed by a magnetic development brush 70. Preferably, brush 70 is electrically biased, in a manner known in the art, so as to apply toner to the non-image areas of the electrostatic image, i.e. those portions of the image in which charge has been dissipated by the imagewise exposure step. Thus, the toner image of the photoconductive layer is a negative image, toner being applied to the exposed regions of the photoconductor.

After forming a negative toner image I' on the photoconductive layer of the auxiliary recording element, the vesicular layer 34 of the recording element 30 is exposed to ultraviolet (i.e. actinic) radiation by a UV source 76 to form a positive vesicular image V. After separating recording element 30 from the auxiliary recording element 40, the vesicular image V is intensified by heating the vesicular layer by a radiant heater 80 to form a visible image I''. Upon illuminating image I'' with white light and viewing the image through the color screen 32, all the colors of the original film F are seen.

In order to reuse the auxiliary recording element 40, a cleaning station 82 is provided to remove the toner image from the photoconductive layer. The cleaning station may comprise a light source for uniformly illuminating the photoconductive layer to discharge any residual charge on the photoconductive layer, and a fur brush or the like for sweeping the toner particles from the photoconductive layer.

While the invention has been described with particular reference to the use of a vesicular layer in combination with the color filter screen, it will be apparent that other low-cost silverless materials could be used. A particularly suitable alternative would be a diazotype material. Such materials, like vesicular materials, are non-sensitive to visible radiation, can be made transparent to visible radiation, and are sensitive to invisible radiation, namely, ultraviolet radiation. When using a diazotype material as a substitute for a vesicular material in elements 12 and 32 in the FIG. 1 and 3 embodiments, the heating step for intensifying the image formed by the ultraviolet radiation exposure would be replaced by a vapor treatment step. Further, it will be appreciated by those skilled in the art that the use of a photoconductive material as the panchromatic material of auxiliary recording element 40 is merely exemplary of those materials which could be used in the process of the invention. The photoconductive material, of course, is advantageous from the standpoint that the image formed thereon and used as a mask in the process can be erased so as to allow the auxiliary element to be used over and over in the process. A suitable substitute for the photoconductive auxiliary recording element would be a photochromic layer, one which is pan-sensitive and transmissive to ultraviolet radiation.

The invention has been described in detail with particular reference to certain preferred embodiments thereof, but it will be understood that variations and modifications can be effected within the spirit and scope of the invention.

I claim:

1. A method for producing color transparent images of a multicolored object on a multilayered recording element which includes an additive color screen and a silverless imaging layer, such imaging layer being substantially insensitive and transparent to visible radiation and responsive to ultraviolet radiation incident thereon to become less transparent to visible radiation, said method comprising the steps of:

(a) forming a monochrome image containing color information of the multicolored object on a panchromatic auxiliary recording element that is separate from said multilayered recording element and is substantially transparent to ultraviolet radiation in a pattern corresponding to image information, said image-forming procedure comprising the steps of illuminating the multicolored object with visible radiation and imagewise exposing the auxiliary recording element to the illuminated object, said imagewise exposure being effected through the multilayered recording element while the relative positions of the auxiliary and multilayered recording elements are substantially fixed; and (b) exposing the silverless imaging layer of the multilayered recording element to ultraviolet radiation, such exposure being effected through the monochrome image formed on the panchromatic auxiliary recording element while said auxiliary recording element and said multilayered recording element occupy substantially the same relative positions as occupied during said imagewise exposing step, whereby the color image information in the panchromatic auxiliary recording element is transferred to the silverless imaging layer of the multilayered recording element.

2. The method according to claim 1 wherein said silverless imaging layer comprises a vesicular material.

3. The method according to claim 1 wherein said silverless imaging layer comprises a diazotype material.

4. The method according to either claim 2 or 3 wherein said panchromatic auxiliary recording element comprises a photoconductive material having a conductive backing which is transmissive to both visible and ultraviolet radiation.

5. A method of recording color image information on a multilayered recording element of the type which includes an additive color screen having an overlying layer of vesicular material, such vesicular material being substantially insensitive and transparent to visible radiation and responsive to ultraviolet radiation to become less transparent when subsequently exposed to visible radiation and heated, said method comprising the steps of:

(a) imagewise exposing a uniformly charged, panchromatic, photoconductive recording element that is separate from said multilayered recording element to color image information, said photoconductive recording element having a conductive backing which is transmissive of both visible and ultraviolet radiation, such exposure being made through the multilayered recording element, whereby a latent electrostatic image containing said color image information is formed on said photoconductive recording element;

(b) developing said electrostatic image to form a monochrome image, portions of such monochrome image being opaque to ultraviolet radiation; and (c) exposing the vesicular layer of said multilayered recording element to ultraviolet radiation, such exposure being effected through said monochrome image on said photoconductive recording element while the photoconductive and multilayered recording elements occupy substantially the same relative positions as they occupied during said imagewise exposure step, whereby the color image information on the photoconductive recording element is transferred to the vesicular layer of the multilayered recording element.

* * * * *